US010918174B2

(12) United States Patent
Liang et al.

(10) Patent No.: US 10,918,174 B2
(45) Date of Patent: Feb. 16, 2021

(54) CONNECTION STRUCTURE CONNECTING WATCHBAND TO WATCHCASE AND WATCH USING THE SAME

(71) Applicant: SHENZHEN FENDA SMART TECHNOLOGY LIMITED, Shenzhen (CN)

(72) Inventors: Siyu Liang, Shenzhen (CN); Li Li, Hong Kong (CN)

(73) Assignee: SHENZHEN FENDA SMART TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 16/517,543

(22) Filed: Jul. 20, 2019

(65) Prior Publication Data

US 2020/0107619 A1 Apr. 9, 2020

(30) Foreign Application Priority Data

Jun. 8, 2018 (CN) ..... 2018 2 0891812 U

(51) Int. Cl.
*A44C 5/14* (2006.01)
*G04B 37/14* (2006.01)

(52) U.S. Cl.
CPC ..... *A44C 5/145* (2013.01); *G04B 37/1486* (2013.01)

(58) Field of Classification Search
CPC ..... A44C 5/14; A44C 5/145; A44C 5/147; Y10T 24/4782; G04B 37/1486
See application file for complete search history.

(56) References Cited

U.S. PATENT DOCUMENTS 5,914,913 A * 6/1999 Shriqui ..... A44C 5/14 224/164
10,085,523 B2 * 10/2018 Perkins ..... A44C 5/2085
2006/0180000 A1 * 8/2006 Pernu ..... G04B 37/1486 84/327
2016/0037876 A1 * 2/2016 Perkins ..... A44C 5/2085 224/164

* cited by examiner

*Primary Examiner* — Robert Sandy

(57) ABSTRACT

A connection structure is configured to connect a watchband including a watchband body to a watchcase including a watchcase body. The connection structure includes a latching member attached to a first end of the watchband body; and an elastic piece attached to the watchcase body and located in a locking slot of the watchcase body. When the latching member is inserted into the locking slot, the latching member is engaged with the elastic piece to thereby engage the watchband body with the watchcase body.

15 Claims, 9 Drawing Sheets

CONNECTION STRUCTURE CONNECTING WATCHBAND TO WATCHCASE AND WATCH USING THE SAME

CROSS REFERENCE TO RELATED APPLICATIONS

This non-provisional patent application claims priority of a Patent Application No. 201820891812.3 filed in The People's Republic of China on Jun. 8, 2018. The application is incorporated herein by reference.

TECHNICAL FIELD

The present invention relates to the field of wearable devices, and in particular to a structure connecting a watchband to a watchcase and a watch.

BACKGROUND

At present, watchbands with different colors and styles appear on the market, and users can select the watchband for their watchcase according to their preferences. However, a spring bar is used to connect the watchband to the watchcase in most of current watches, and professional tools are therefore needed to disassemble and assemble the watchband and the watchcase. Thus, it is difficult for users to disassemble and assemble the watchband and the watchcase.

In view of this, it is necessary to improve a connection structure connecting the watchband to the watchcase.

SUMMARY

The objective of the present disclosure is achieved by the following technical solutions:

The present disclosure provides a connection structure connecting a watchband with a watchband body to a watchcase with a watchcase body. The connection structure comprises a latching member attached to a first end of the watchband body, and an elastic piece attached to the watchcase body and located in a locking slot of the watchcase body. When the latching member is inserted into the locking slot, the latching member is engaged with the elastic piece to thereby engage the watchband body with the watchcase body.

Preferably, a catching member is disposed at the first end of the watchband, and the latching member is partially embedded in the catching member.

Preferably, the latching member is a metal member, and a through hole is disposed at the metal member; a nut is wrapped in the catching member, a screw is disposed to pass through the through hole to connect to the nut, and the metal member is fixed to the watchband body by screwing of the screw and the nut.

Preferably, a locking notch is disposed in the catching member, a hook portion is disposed at the metal member, and the hook portion is engaged in the locking notch.

Preferably, a locking member is disposed at the first end of the watchcase body, the locking slot is formed in the locking member, and the locking slot is a T-shaped locking slot; a bent portion is disposed at two sides of the elastic piece, and is fixed to an edge of the locking member corresponding to the bent portion.

Preferably, the elastic piece is convexly provided with a spring bulge, and the metal piece is provided with a recess matching with the spring bulge.

Preferably, a T-shaped limiting slot is formed in the elastic piece, and the two sides of the metal member are configured with a strap detent matching with the limiting slot.

The present disclosure provides a watch includes a watchband, a watchcase connected to the watchband, and a structure configured to connect the watchband to the watchcase; the structure configured to connect the watchband to the watchcase includes a first connecting part disposed at the watchband, and a second connecting part disposed at the watchcase and connected to the first connecting part; the watchband includes a watchband body and a latching member limited to a first end of the watchband body; the watchcase includes a watchcase body and an elastic piece disposed to the watchcase body, a first end of the watchcase body is configured with a locking slot, and the elastic piece is located in the locking slot; the first end of the watchband is adjacent to the first end of the watchcase; the first connecting part includes the latching member, and the second connecting part includes the elastic piece and the locking slot; when the latching member is inserted into the locking slot, the latching member is engaged with the elastic piece, and the watchband body is engagedly connected to the watchcase body.

BRIEF DESCRIPTION OF THE DRAWINGS

In order to more clearly illustrate the embodiments of the present disclosure, the figures in the embodiment will be briefly described below. Obviously, the figures are merely included in some embodiments of the present disclosure, and a person skilled in the prior art can obtain other figures according to the structures shown in the figures without any creative work.

The implementation, functional features, and advantages of the present disclosure will be further described with reference to the figures.

DETAILED DESCRIPTION OF THE PREFERRED EMBODIMENTS

Below, embodiments of the present invention will be described in greater detail with reference to the figures. It is obvious that the described embodiments are only a part of the embodiments of the present disclosure, and not all of them. On the basis of the described embodiments, other embodiments obtained by a person skilled in the art without creative work are within the scope of the present disclosure.

It should be noted that the descriptions of "first", "second" and the like in the present disclosure are only for the purpose of description, and are not understood as indicating or implying their relative importance or the number of the technical feature. Thus, the technical features defined "first" and "second" may explicitly or implicitly include at least one of the technical features. In addition, the technical solutions between the different embodiments may be combined with each other when the person skilled in the art can implement the technical solution. If the combination of the technical solutions is contradictory or impossible to be implemented, it should be considered that the combination of the technical solutions does not exist, and it is not within the protection scope of the present disclosure.

Example 1

Figure 1:
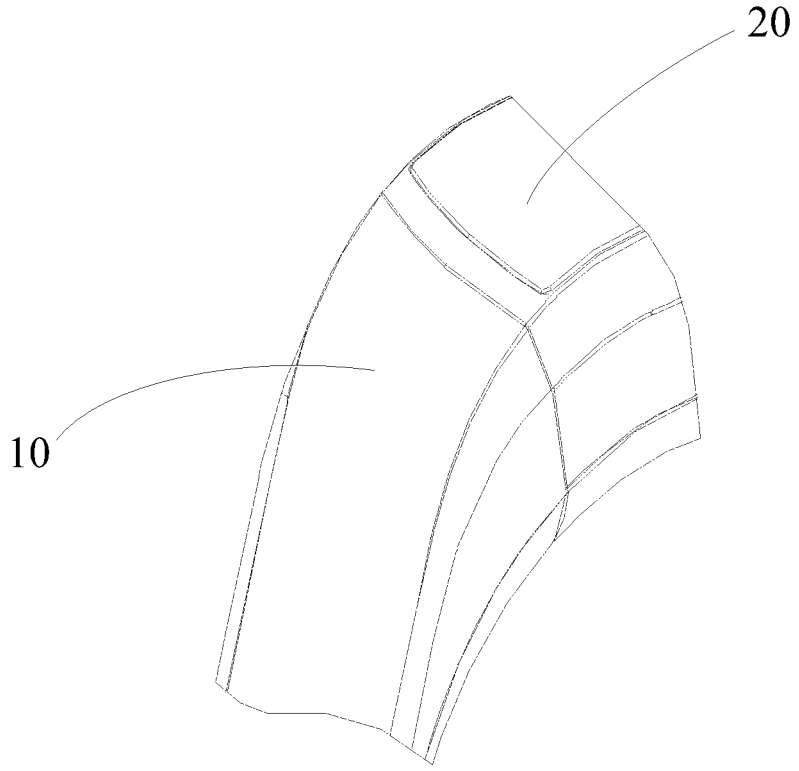
FIG. 1 is an assembled view of a connection structure connecting a watchband to a watchcase according to an embodiment of the present invention.
Figure 2:
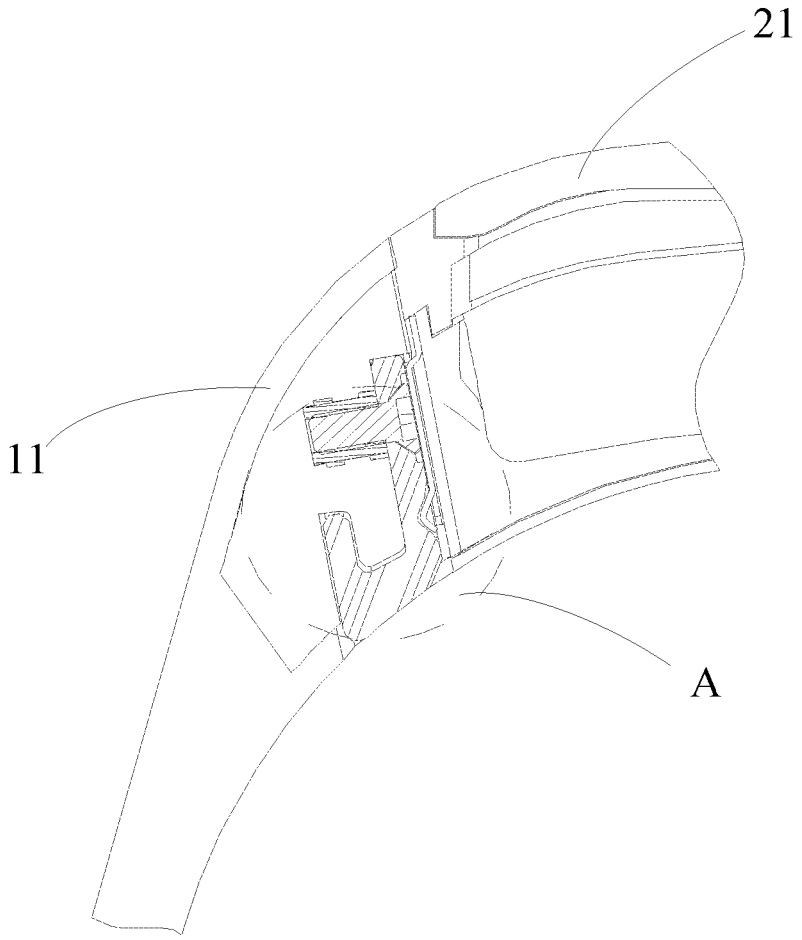
FIG. 2 is a cross-sectional view of FIG. 1.
Figure 3:
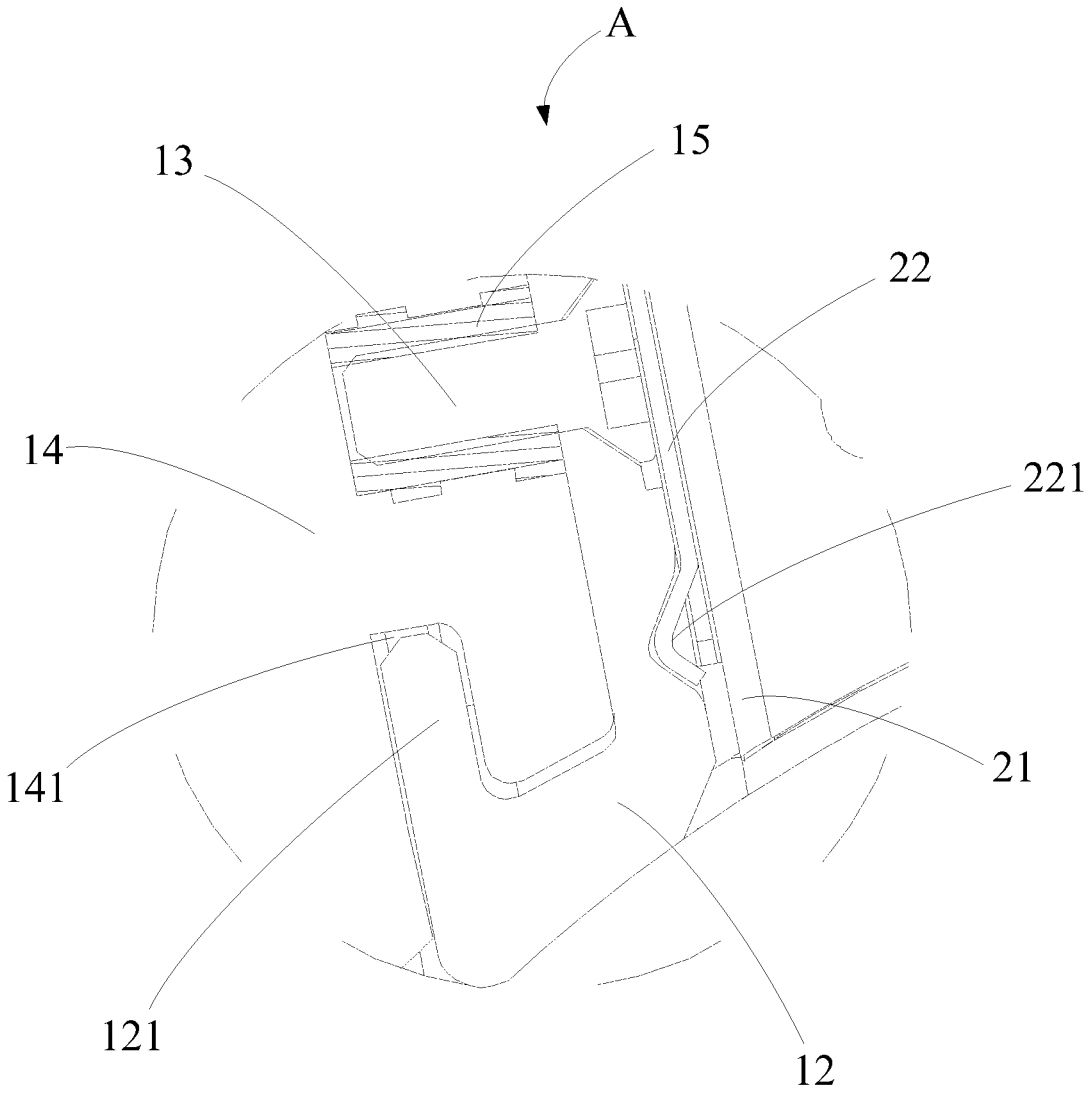
FIG. 3 is an enlarged view of circle A in FIG. 2.
Figure 4:
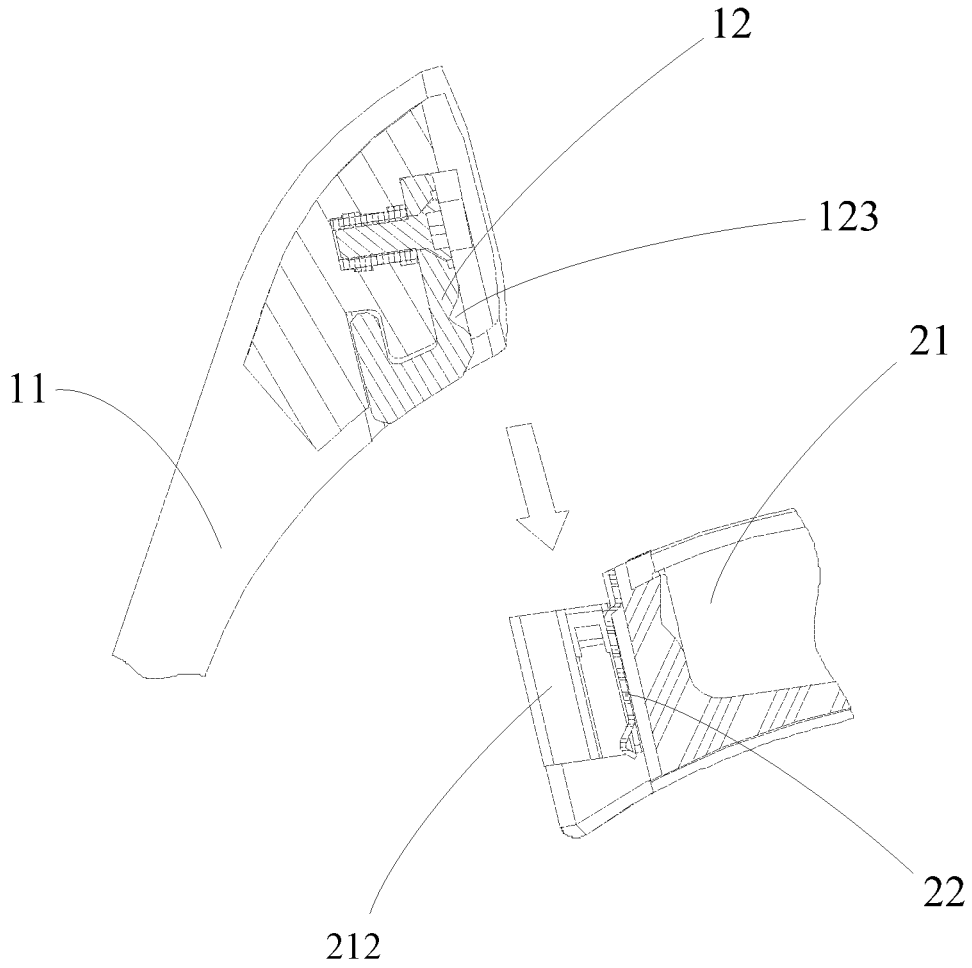
FIG. 4 is a schematic view of assembling the watchband to the watchcase according to the embodiment.
Figure 5:
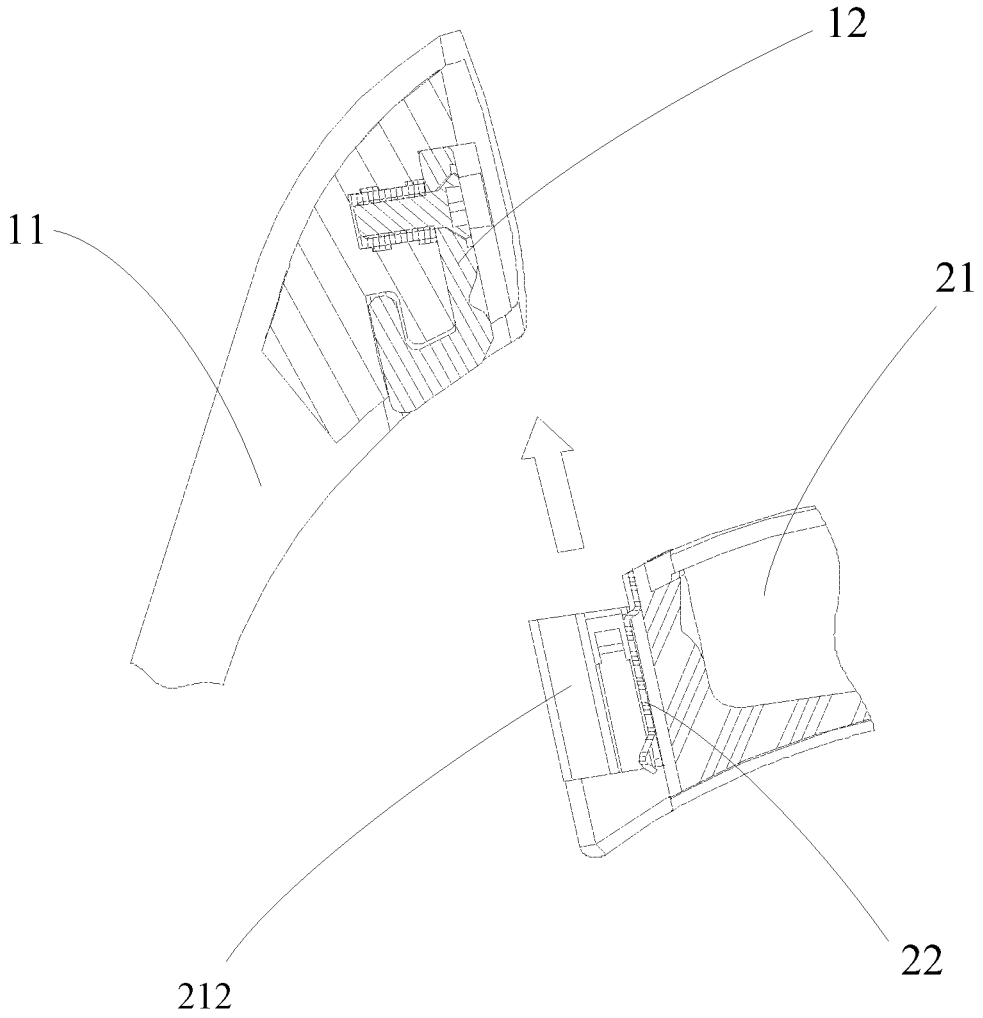
FIG. 5 is a schematic view of disassembling the watchband from the watchcase according to the embodiment.

Referring to FIG. 1 to FIG. 5, FIG. 1 is an assembled view of a structure configured to connect a watchband to a watchcase according to an embodiment of the present disclosure, FIG. 2 is a cross-sectional view of FIG. 1, FIG. 3 is an enlarged view of circle A in FIG. 2, FIG. 4 a schematic view of assembling the watchband to the watchcase according to the embodiment, and FIG. 5 is a schematic view of disassembling the watchband from the watchcase according to the embodiment. In the embodiment of the present disclosure, the user can quickly disassemble the watchband 10 from the watchcase 20, and assemble the watchband 10 to the watchcase 20 through the connection structure between the watchband 10 and the watchcase 20. The watchband 10 includes a watchband body 11 and a latching member 12 limited to a first end of the watchband body 11. The watchcase 20 includes a watchcase body 21 and an elastic piece 22 disposed in the watchcase body 21, a first end of the watchcase body 21 is configured with a locking slot 212, and the elastic piece 22 is located in the locking slot 212. The first end of the watchband 10 is adjacent to the first end of the watchcase 20. When the latching member 12 is inserted into the locking slot 212, the latching member 12 is engaged with the elastic piece 22, such that the watchband body 11 is engagedly connected to the watchcase body 21.

In this embodiment, after the watchband 10 is quickly assembled to the watchcase 20, the appearance of the product is relatively completed. The user can assemble the watchband 10 to the watchcase 20 according to the FIG. 4, and disassemble the watchband 10 from the watchcase 20 according to the FIG. 5, therefore, the user can easily replace the watchband 20 according to his/her own preference. Specifically, the first end of the watchband body 11 is provided with the latching member 12, the first end of the watchcase body 21 is configured with the locking slot 212, and the elastic piece 22 are disposed in the locking slot 212, the watchband body 11 is fixedly connected to the watchcase body 21 through the cooperation between the latching member 12 and the elastic piece 22.

In the present disclosure, the structures of the watchband 10 and the watchcase 20 are improved, and the watchband 10 is detachably connected to the watchcase 20. Specifically, the first end of the watchband body 11 is disposed with the latching member 12, the first end of the watchcase body 21 is disposed with the locking slot 212, and the elastic piece 22 is disposed in the locking slot 212. When the latching member 12 is inserted into the locking slot 212, the latching member 12 is engaged or interlocked with the elastic piece 22, such that the watchband body 11 is engagedly and detachably connected to the watchcase body 21. Thus, the user can easily change the watchband 10 without special tools.

Figure 6:
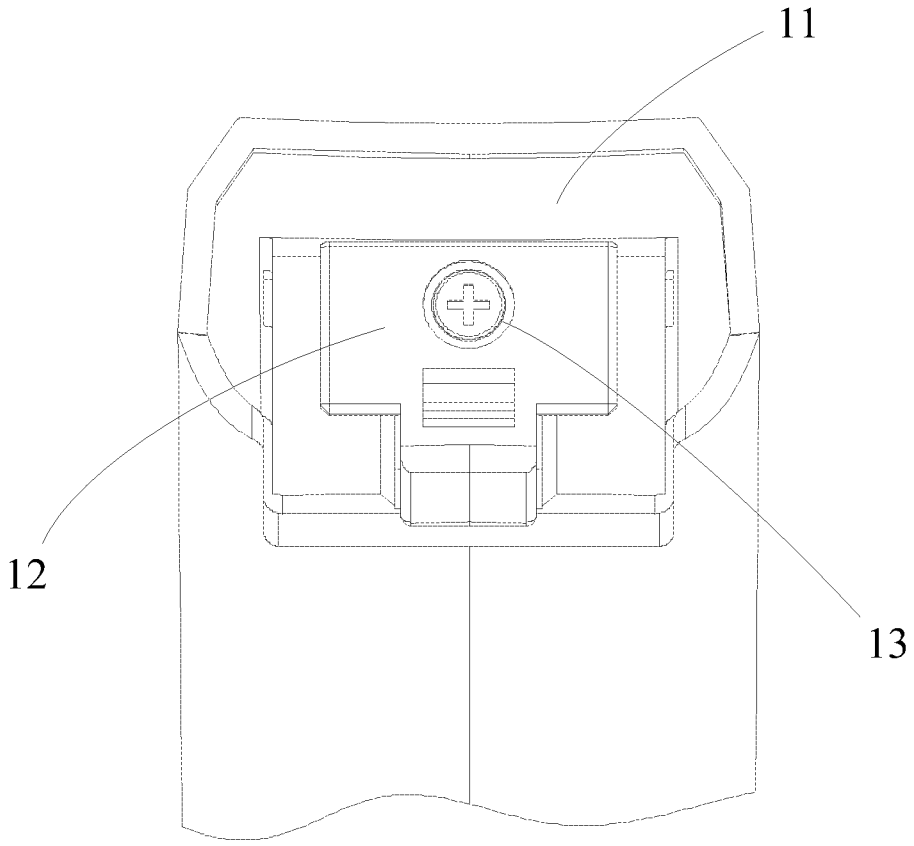
FIG. 6 is a side view of the watchband of FIG. 1.
Figure 7:
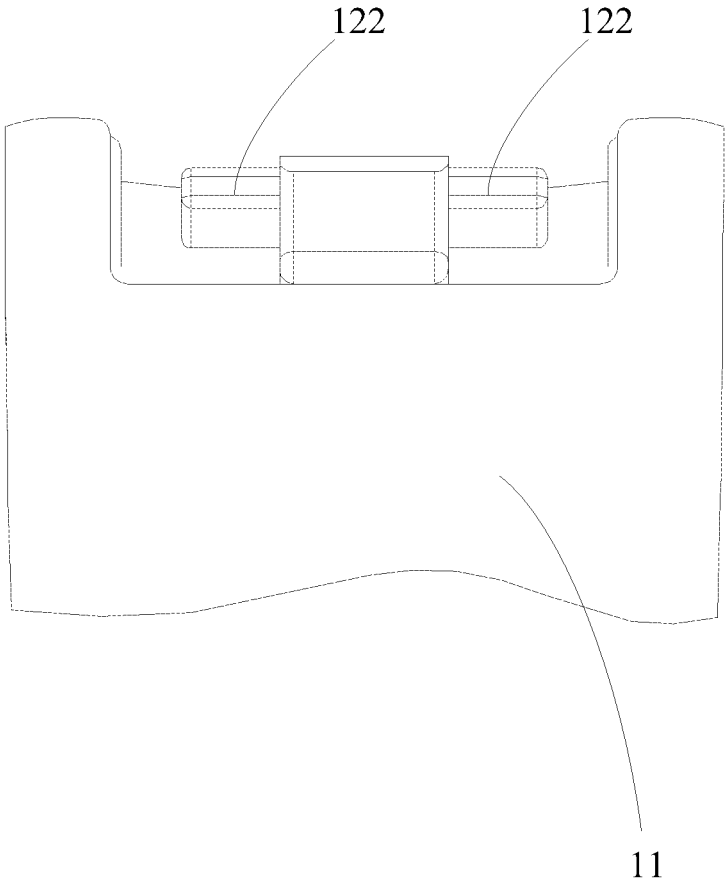
FIG. 7 is a bottom view of the watchband.

Referring to FIG. 6 and FIG. 7, FIG. 6 is a side view of the watchband of FIG. 1, and FIG. 7 is a bottom view of the watchband. In the embodiment, a catching member 14 is disposed at the first end of the watchband 10. Preferably, the catching member 14 is fixed with the watchband 10 as a single unit via inserting molding. The latching member 12 is partially embedded in the catching member 14, thereby fixing the latching member 12 to the watchband 10. In the disclosure, at least two methods may be used to locate the latching member 12, one method is to fix the latching member 12 to the catching member 14 through a screw 13, another method is to engage the latching member 12 in a locking notch 141 formed in the catching member 14.

As a preferred embodiment, the latching member 12 is a metal member, a through hole (not labelled) is defined in the metal member, a nut 15 is embedded in the catching member 14, and the screw 13 passes through the through hole to connect to the nut 15. Thus, the metal member is fixed to the watchband body 11 by engagement of the screw 13 and the nut 15. Preferably, the nut 15 is a metal nut, such as a copper nut and so on.

As a preferred embodiment, the locking notch 141 is formed in the catching member 14, a hook portion 121 is formed at a distal end of the latching member 12, and the hook portion 121 is engaged in the locking notch 141, thereby increasing the reliability of fixing the latching member 12 to the watchband body 11, and further ensuring the watchband 10 to be reliably connected to the watchcase 20.

Figure 8:
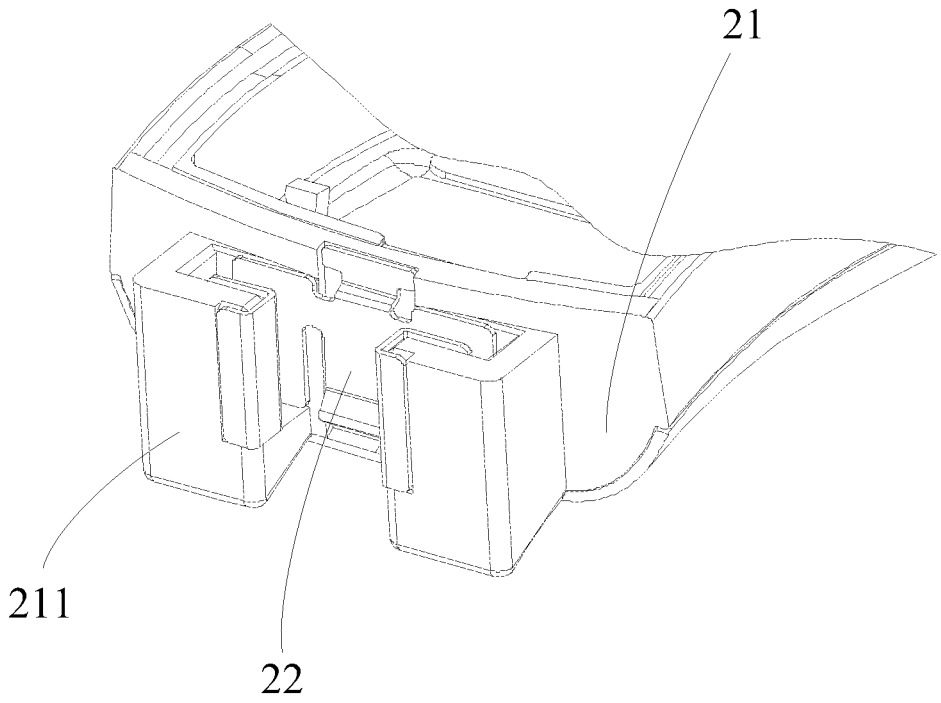
FIG. 8 is an overall structural view of the watchcase of FIG. 1.
Figure 9:
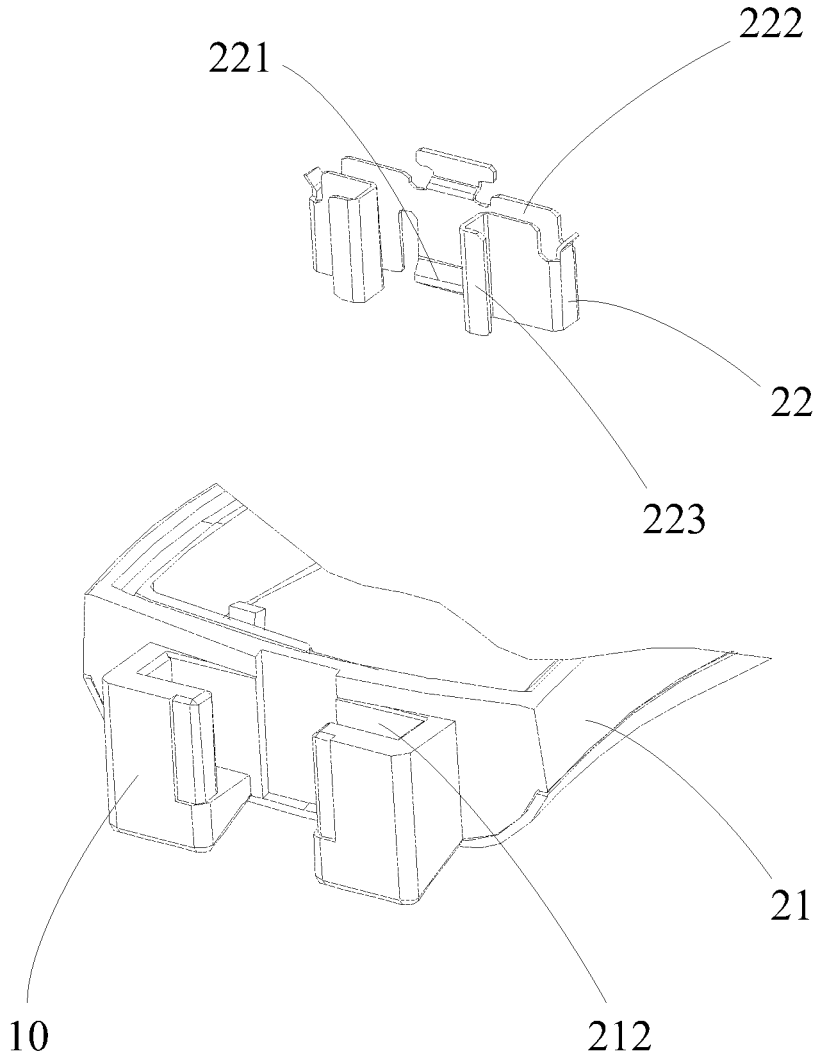
FIG. 9 is an exploded view of FIG. 8.

Referring to FIG. 8 and FIG. 9, FIG. 8 is an overall structural view of the watchcase of FIG. 1, and FIG. 9 is an exploded view of FIG. 8. In the embodiment, the first end of the watchcase body 21 is configured with a locking member 211, the locking slot 212 is formed in the locking member 211, and the locking slot 212 is preferably a T-shaped locking slot. A bent portion 223 is formed at two sides of the elastic piece 22, and is fixed to an edge of the locking member 211 corresponding to the bent portion 223. Thus, the elastic piece 22 is stably mounted in the locking slot 212, and is avoided from being taken out when the watchband 10 is disassembled from the watchcase 20.

As a preferred embodiment, the elastic piece 22 is convexly provided with a spring bulge 221, and the latching member 12 is formed with a recess 123 matching with the spring bulge 221. The engagement of the spring bulge 221 and the recess 123 facilitates to locate the watchband body 11 and the watchcase body 21, and therefore improve the position effect between the watchband body 11 and the watchcase body 21. Preferably, a T-shaped limiting slot 222 is formed in the elastic piece 22, and the two sides of the latching member 12 are configured with a strap detent 122 matching with the limiting slot 222, thereby improving the connecting reliability of the watchband 10 and the watchcase 20.

Example 2

The embodiment of the present invention provides a watch including the above-mentioned connection structure configured to connect the watchband to the watchcase. The structure configured to connect the watchband to the watchcase has been described in the first embodiment, and is not described herein again. And the watch in the embodiment has all the advantages and effects of the structure configured to connect the watchband to the watchcase.

The above embodiments are only the preferred embodiments of the present invention, and do not limit the scope of the present invention. A person skilled in the art may make various other corresponding changes and deformations based on the described technical solutions and concepts. And all such changes and deformations shall also fall within the scope of the present invention.

What is claimed is:

1. A connection structure connecting a watchband comprising a watchband body to a watchcase comprising a watchcase body, the connection structure comprising:

a latching member attached to a first end of the watchband body; and an elastic piece attached to the watchcase body and located in a locking slot of the watchcase body;

wherein when the latching member is inserted into the locking slot, the latching member is engaged with the elastic piece to thereby engage the watchband body with the watchcase body;

wherein a catching member is disposed at the first end of the watchband, and the latching member is partially embedded in the catching member.

2. The connection structure of claim 1, wherein the latching member is a metal member, and a through hole is defined in the metal member, a nut is fixed in the catching member, and a screw passes through the through hole to engage with the nut to thereby engage the metal member to the watchband body.

3. The connection structure of claim 2, wherein a locking notch is disposed in the catching member, a hook portion is formed at the metal member, and the hook portion is engaged in the locking notch.

4. The connection structure of claim 2, wherein a locking member is disposed at the first end of the watchcase body, the locking slot is formed in the locking member, and the locking slot is a T-shaped locking slot.

5. The connection structure of claim 4, wherein a bent portion is formed at each of two sides of the elastic piece, and is fixed to an edge of the locking member corresponding to the bent portion.

6. The connection structure of claim 4, wherein the elastic piece is convexly provided with a spring bulge, and the metal member is provided with a recess matching with the spring bulge.

7. The connection structure of claim 5, wherein a T-shaped limiting slot is formed in the elastic piece, and two sides of the metal member are configured with a strap detent matching with the limiting slot.

8. The connection structure of claim 1, wherein the catching member is fixed with the watchband as a single unit via inserting molding.

9. A watch comprising:

a watchband comprising a watchband body comprising a first end;

a watchcase comprising a watchcase body, the watchcase body comprising a first end adjacent to the first end of the watchband body, the first end of the watchcase body being configured with a locking slot; and a connection structure configured to connect the watchband to the watchcase, the connection structure comprising a latching member attached to the first end of the watchband body, and an elastic piece located in the locking slot;

wherein when the latching member is inserted into the locking slot, the latching member is engaged with the elastic piece to thereby engage the watchband body with the watchcase body;

wherein a catching member is disposed at the first end of the watchband, and the latching member is partially embedded in the catching member.

10. The watch of claim 9, wherein the latching member is a metal member, and a through hole is defined in the metal member, a nut is fixed in the catching member, and a screw passes through the through hole to engage with the nut to thereby engage the metal member to the watchband body.

11. The watch of claim 10, wherein a locking notch is disposed in the catching member, a hook portion is disposed at the metal member, and the hook portion is engaged in the locking notch.

12. The watch of claim 10, wherein a locking member is disposed at the first end of the watchcase body, the locking slot is formed in the locking member, and the locking slot is a T-shaped locking slot; a bent portion is disposed at two sides of the elastic piece, and is fixed to an edge of the locking member corresponding to the bent portion.

13. The watch of claim 12, wherein the elastic piece is convexly provided with a spring bulge, and the metal piece is provided with a recess matching with the spring bulge.

14. The watch of claim 13, wherein a T-shaped limiting slot is formed in the elastic piece, and the two sides of the metal member are configured with a strap detent matching with the limiting slot.

15. The watch of claim 9, wherein the catching member is fixed with the watchband as a single unit via inserting molding.

* * * * *